United States Patent [19]

McCann et al.

[11] Patent Number: 4,712,591

[45] Date of Patent: Dec. 15, 1987

[54] LIQUID DISPENSER WITH AUTOMATIC SHUT-OFF

[75] Inventors: Gerald P. McCann, Los Angeles; Andrew J. Holoubek, Valencia; Donald Verley, Saugus, all of Calif.

[73] Assignee: McCann's Engineering and Manufacturing Co., Los Angeles, Calif.

[21] Appl. No.: 840,895

[22] Filed: Mar. 18, 1986

[51] Int. Cl.[4] ..... B65B 3/04

[52] U.S. Cl. ..... 141/88; 141/198; 141/360; 141/95; 73/293; 367/908

[58] Field of Search ..... 141/94, 95, 96, 192–229, 141/360–362, 85–88; 367/908; 73/293

[56] References Cited

U.S. PATENT DOCUMENTS 4,202,387 5/1980 Upton ..... 141/94
4,440,200 4/1984 DeVale et al. ..... 141/95
4,558,735 7/1984 Houman ..... 141/95
4,572,253 2/1986 Farmer et al. ..... 141/95

*Primary Examiner*—Houston S. Bell, Jr.
*Attorney, Agent, or Firm*—Lyon & Lyon

[57] ABSTRACT

A drink dispenser assembly used for filling receptacles when placed into a position to receive liquid dispensed from a nozzle comprises a valve which is controlled by a solenoid connected to an electric circuit, a switch operated at the will of the operator to actuate the electric circuit and the solenoid to open the valve and initiate a filling cycle, an assembly operative to suspend the receptacle below the nozzle, and an arm positioned proximate the receptacle when the receptacle is placed into a position to receive liquid, the arm operative to sense the filled condition of the receptacle and deactuate the electric circuit and the solenoid to close the valve and terminate the filling cycle.

27 Claims, 3 Drawing Figures

LIQUID DISPENSER WITH AUTOMATIC SHUT-OFF

BACKGROUND

This invention relates to liquid dispensers, and in particular, those that are useful to automatically terminate the filling cycle when the level of liquid in a receptacle exceeds a predetermined level.

The restaurant and bar industry through the years has required liquid dispensers, wherein the operator, such as a waiter or bartender, places a receptacle into a position to receive a liquid and then dispenses a liquid from a nozzle to a level desired by the operator. In early days the receptacle was placed below the nozzle and a manually actuated lever was pushed away from the operator to open the valve and dispense liquids. Subsequently, a solenoid attached to an electric circuit was used to operate a valve, wherein upon pushing a button to actuate the electric circuit the valve would open and dispense liquid into the receptacle. For soft drink dispensing, it was common to have soda water operative with one valve and syrup operative with another valve wherein both valves would feed a nozzle. By actuating the solenoids through a switch element to open the valves it was possible to dispense carbonated liquid into a receptacle to a level desired by the operator.

Although such prior devices were used primarily for dispensing carbonated liquids, such devices could also be used for dispensing coffee, tea and any other of the beverages commonly offered at restaurants or bars.

In the fast food industry it became desirable to have an automatice filling device. These automatic filling devices took many forms, however, most commonly these automatic filling devices either consisted of a timing circuit attached to the solenoid, whereby the electric circuit was actuated by a switch which would then maintain the solenoid in an actuated state to keep the valve open for a predetermined time. At the expiration of the time the solenoid would de-actuate and close the valve to terminate the filling cycle.

Such prior devices suffered from the problem that when dispensing carbonated liquids, which were commonly served with a certain volume of ice, it was difficult to control the amount of ice placed within the receptacle, consequently a predetermined time period would dispense a predetermined amount of liquid and if ice in excess of a certain amount existed within the receptacle the liquid would overflow the receptacle, thereby creating a wasteful and unsanitary situation.

Other prior devices utilized a volumetric approach, whereby a certain volume of liquid was dispensed into a receptacle at the will of the operator. Such prior devices also suffered from the inherent deficiency that it was difficult to control the amount of ice placed into a receptacle by the operator, consequently by dispensing a certain volume of liquid it often occurred that the volume of liquid would overflow the receptacle because of the amount of ice placed within the receptacle. These prior devices created both an unsightly and unsanitary condition, which long plagued the soft drink or liquid dispensing industry.

Such prior devices also had an inherent deficiency in that different sized receptacles could not be used, because a filling cycle established for a certain period of time or based upon a certain volume of liquid was not adaptable to changes in receptacle size. It was difficult to accurately control the amount of liquid dispensed, and consequently operator attendance was continuously required.

Attempts have been made to solve some of the problems inherent in these prior systems. A probe was suspended from the lower portion of the faucet assembly next to the nozzle, whereby movement of the receptacle toward the probe to contact and rotate the probe would initiate the filling cycle. The filling cycle was then controlled by a probe in contact with the rim of the receptacle. When the fluid/foam over filled the receptacle and contacted the probe the filling cycle was terminated. The drawback to these devices was the fact that the probe actually contacted the cup rim and if a cup was brought back for a refill various viruses could be transferred to the cup lever and thereby to another user.

In the prior device of U.S. Pat. No. 3,916,963 an automatic drink dispenser is shown for filling cups with a liquid when placed into a receiving position on a platform. The automatic drink dispenser includes a solenoid controlled valve for dispensing liquid into cups. A pivotal contact member is positioned below the nozzle so that movement of the cup toward the contact member caused the contact member to pivot about an axis thereby actuating a microswitch. The microswitch is operative to energize an electric circuit and a solenoid to open a valve and initiate dispensing of the liquid. When the liquid reached a predetermined level a sensing member which is suspended below the nozzle and was connected to the contact member is contacted by the liquid or foam as it reaches a predetermined level and overflows the cup. An electrical means interconnecting the sensing member and the solenoid controlled valve closes the valve to stop the flow of liquid.

Although the device of U.S. Pat. No. 3,916,963 was able to solve some of the deficiencies of prior devices other undesirable characteristics appeared. For example, the liquid within the cup would touch the sensing member, and indeed had to touch the sensing member to terminate the filling cycle. Oft times, an individual orders a cup of liquid such as a soft drink and drinks a certain portion of the drink and then asks for a refill. In such cases the same cup is used, although partially filled, and upon refilling liquid placed into the cup would rise to a certain level to touch the sensing member. Consequently, a partially empty cup which had made contact with a person's mouth and contained perhaps some saliva would then be refilled, and the individual's saliva and possibly viruses or bacterial organisms from their mouth would rise with the liquid in the cup during the filling cycle and touch the contact member or sensing member. Consequently, the contact member or sensing member often became contaminated with saliva and viruses or bacterial organisms from individual's mouths. Due to the presence of certain viruses these automatic dispensers have become undesirable to use.

The automatic drink dispenser of U.S. Pat. No. 3,916,963 illustrates another deficiency in that certain liquids, such as root beer, have a tendency to foam a great deal. Consequently, as the foam contacted the sensing member extending downwardly into and toward the cup the valve would shut-off even though the liquid had not reached a sufficient level within the cup. Consequently, the operator would have to remove the cup and thereby pivot the contact member to its original position, and then re-insert the cup to rotate the contact member to actuate the microswitch and again initiate the filling cycle. When using liquids which foamed a great deal this was highly undesirable, because it required considerable movement of the cup into and out of the receiving position, causing additional spillage and seriously degrading the efficiency of the operator.

SUMMARY OF THE INVENTION

The present invention provides a control system for a liquid dispenser which solves the deficiencies of the prior systems and eliminates the constant operator intervention that necessarily occurred in prior devices. The present invention also provides a far more sanitary system, which eliminates the problems encountered from both spillage and liquid contacting a contact member found in prior devices.

Therefore, it is an object of the present invention to provide a new and improved liquid dispenser assembly used for filling receptacles, when placed into a position to receive liquid, which is automatic in operation.

It is another object of the present invention to provide a liquid dispenser which automatically shuts-off the flow of liquid into a receptacle or receiving element when the liquid level reaches a certain predetermined level.

It is another object of the present invention to eliminate constant operator intervention which necessarily occurred in prior devices used for dispensing soft drinks which had a tendency to create a great deal of foam.

Another object of the present invention is to provide a liquid dispenser which can be used with receptacles of varying height and varying volumes.

It is another object of the present invention to eliminate the tendency of liquid dispensers to spill excessive amounts of liquid when a certain volume of liquid is placed into the receptacle.

It is another object of the present invention to provide a liquid dispenser which avoids contact of the liquid with a probe, wherein some of the liquid then travels back into the receptacle, thereby placing whatever organisms exist on the probe back into the receptacle.

It is another object of the present invention to provide a liquid dispenser which is reliable in operation and consists of relatively few moving parts.

It is another object of the present invention to provide a liquid dispenser which is initiated at the will of the operator by contacting a switch and terminated when the liquid reaches a certain predetermined level.

It is another object of the present invention to provide a liquid dispenser which is easily installed in existing dispensers.

It is another object of the present invention to provide a liquid dispenser which requires little operator intervention, such as continuously removing and replacing a receptacle to top-off the receptacle.

It is another object of the present invention to provide a liquid dispenser which can be easily repaired and replaced.

These objects and other objects of the present invention are accomplished in the preferred embodiment by providing a liquid dispenser assembly used for filling receptacles when placed into a position to receive liquid dispensed from a nozzle which comprises a valve which is controlled by a solenoid connected to an electric circuit, a switch operated at the will of the operator to actuate the electric circuit and the solenoid to open the valve and initiate the filling cycle, an assembly operative to suspend the receptacle below the nozzle, and an arm positioned proximate the receptacle when the receptacle is placed into a position to receive liquid, the arm operative to sense the filled condition of the receptacle and deactuate the electric circuit to close the valve and terminate the filling cycle.

Although the drink dispenser of the present invention is not to be limited by the foregoing objects or brief summary above, a better understanding of the present invention is to be had by the following detailed description of the preferred embodiment taken in conjunction with the drawings.

IN THE DRAWINGS

DETAILED DESCRIPTION OF THE PREFERRED EMBODIMENT

Figure 1:
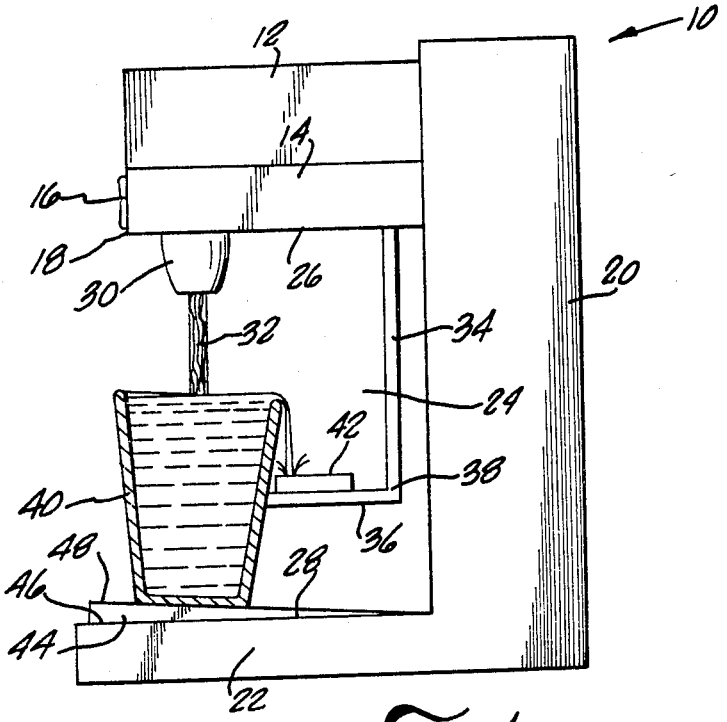
FIG. 1 is a side elevational view illustrating a preferred embodiment of the liquid dispenser of the present invention.

Referring now to the drawings, wherein like or corresponding reference numerals are used to designate like or corresponding parts or components throughout the serial views, there is shown in FIG. 1 a drink dispenser 10, in accordance with the present invention, including an upper dispensing faucet housing 12 which contains the fluid circuitry including the feed lines (not shown), which operate to bring the liquid to be dispensed from the liquid dispenser into the region of the nozzle. Below the upper faucet housing 12 is a lower faucet housing 14 which contains the solenoid operated valves (not shown) which are operative to open or close the feed lines to the nozzle.

When dispensing liquids such as carbonated sodas, there is commonly a soda water feed line and a syrup feed line which meet at a position downstream of the valves to mix the soda water and syrup before dispensing through the nozzle. A faucet actuator 16 is located on the face 18 of the lower faucet housing 14 and is positioned to be easily accessible to the operator. It should be understood that although the faucet actuator 16 is shown in the preferred embodiment located on a face of the lower faucet housing 14 it is possible to locate the faucet actuator 16 at various other locations, either on the liquid dispenser 10 or in the cabinetry surrounding the liquid dispenser 10 or at other convenient locations easily accessible to the operator.

A dispensing tower 20 having a base section 22 is useful to support the upper and lower faucet housings 12, 14 by attachment thereto to create a workspace 24 below the bottom surface 26 of the lower faucet housing 14 and above the upper surface 28 of the base 22. A nozzle 30 of the conventional style, which is commonly made of a plastic material, projects downwardly from the lower surface 26 of lower faucet housing 14 and the nozzle 30 is communicated to the feed lines (not shown), whereby the liquid 32 to be dispensed flows from the nozzle 30 downwardly toward the receptacle placed under the nozzle 30. Although the present invention contemplates the use of a tower 20 and base 22 it should be understood that the present invention may be used in an existing liquid dispensing unit to accomplish the same desired results. Consequently, the applicant is not limited to the specific tower 20 and base 22 relationship shown herein.

A downwardly extending pole 34 projects from the bottom surface 26 of the lower faucet housing 14 and into the workspace 24. The pole 34 has a substantially horizontal outwardly extending arm 36 attached at the elbow 38, wherein the arm 36 projects away from the dispensing tower 20 to maintain the cup or receptacle 40 a discreet distance from the pole 34 and the tower 20. A receptor 42 is attached to the upper surface of arm 36 and located so that any liquid or foam flowing out of the receptacle 40 will strike the receptor 42. The arm 36 and the receptor 42 have faces contoured such that any foam or liquid falling upon either the arm 36 or the receptor 42 will immediately drain off and thus not accumulate. Such draining is accomplished through the base 22, as set forth in greater detail hereinafter.

Attached to the upper surface 28 of the base 22 is a ramp 44 which has a substantially flat lower surface 46 and an inclined upper surface 48. The inclination angle of the upper surface 48 may vary, however, in the preferred embodiment the inclination angle is between 5 and 10 degrees. The ramp 44 includes perforations or a grid structure (not shown) along the upper surface 48 to receive any excess liquid that falls from the receptacle 40. The ramp 44 is also perforated along its bottom surface to communicate any liquids to the upper surface 28 at the base 22. A drain assembly (not shown) is located in the base 22 to receive liquid flowing out of the receptacle 40 or any other liquids that arise in the area of the liquid dispenser and communicate those liquids away from the liquid dispenser 10 to a drain (not shown) in the surrounding cabinetry or work station.

Figure 2:
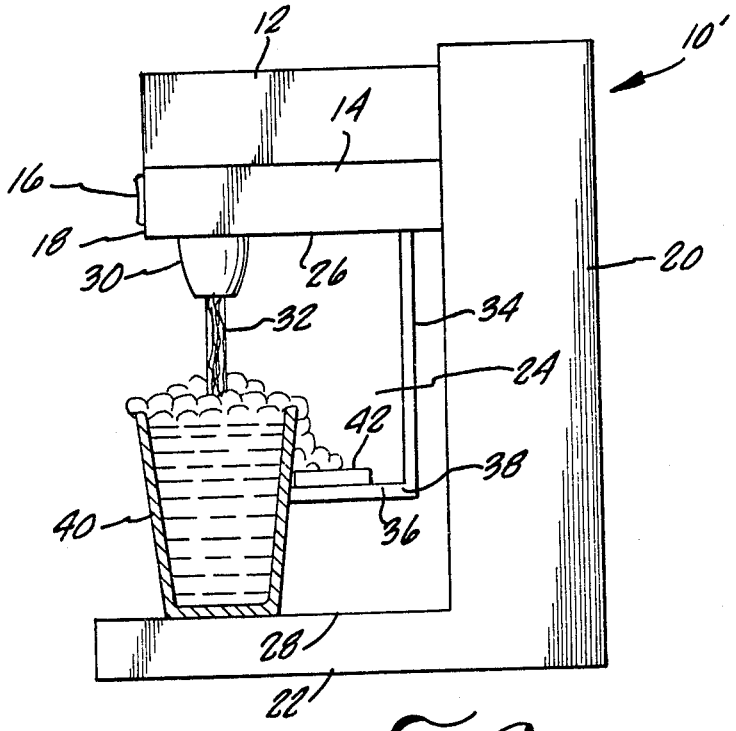
FIG. 2 is a second preferred embodiment of the present invention.

In FIG. 2 a second preferred embodiment of the present invention is shown, whereby the ramp 44 shown in the first embodiment is not present. In this embodiment the perforations or grid structure (not shown) which were previously located on the top surface 48 of the ramp 44 are now located on the top surface 28 of the base 22. The embodiment of FIG. 2 is particularly useful for liquids, which have a tendency to foam, such as soft drinks of the root beer variety, whereas the embodiment of FIG. 1 is useful for either liquids that foam or those that do not. The use of the drink dispenser 10 of FIG. 1 has the advantage in that the receptacle 40, which has a substantially circular upper periphery will cause overfill to always occur over a defined portion of the upper peripheral portion of receptacle 40, which is proximate the receptor 42. In the configuration of FIG. 2, without the ramp 44, the foam or liquid may overflow the periphery of the receptor 40 at various locations, including those locations distant from the receptor 42, consequently, some additional flow may occur prior to termination of the filling cycle. The use of the ramp 44, as shown in FIG. 1 is also desirable, because the receptacle 40 will always slide to contact the arm 36 and thus the nozzle 30 will always be aligned to place liquid into the receptacle 40.

Although the arm 36 is shown to be of one specific configuration in the present invention, it should be understood that arm 36 may take various configurations including a yokeshaped configuration or a configuration having a semicircular rib attached to the outer surface of the arm 30 to support the receptacle 40 in a substantially stationary position with respect to the drink dispenser 10.

It should be appreciated that although the present application illustrates a preferred embodiment of the present invention other assemblies or components are available for accomplishing the same result, which do not depart from the spirit of the invention. For example, to actuate the faucet, a push button switch, a capacitance switch, an inductance switch, a temperature sensing switch or a pressure sensitive switch may be used. Any of these types of switches will serve the function of actuating the microswitch to initiate the filling cycle. Also, a photocell system may be used to sense the presence of a receptacle 40 within the space 28 to initiate the filling cycle. Also a sonic actuated or conductance actuated system may be developed to sense the presence of the receptacle 40 and initiate the filling cycle or to terminate the filling cycle. Other control systems such as those including a magnetic detector, may be used to sense the presence of a receptacle 40 when a magnetic line is printed upon the bottom of the receptacle 40 and a corresponding magnetic sensor is placed in the base 22. In these instances, placement of the receptacle 40 over the ramp 44 or base 22 will initiate the filling cycle.

Important to the present invention is that neither the actuator mechanism or the receptor makes contact with the rim of the receptacle 40, thereby preventing foreign organisms present on the actuating mechanism or receptor mechanism of prior devices from entering the receptacle 40.

Figure 3:
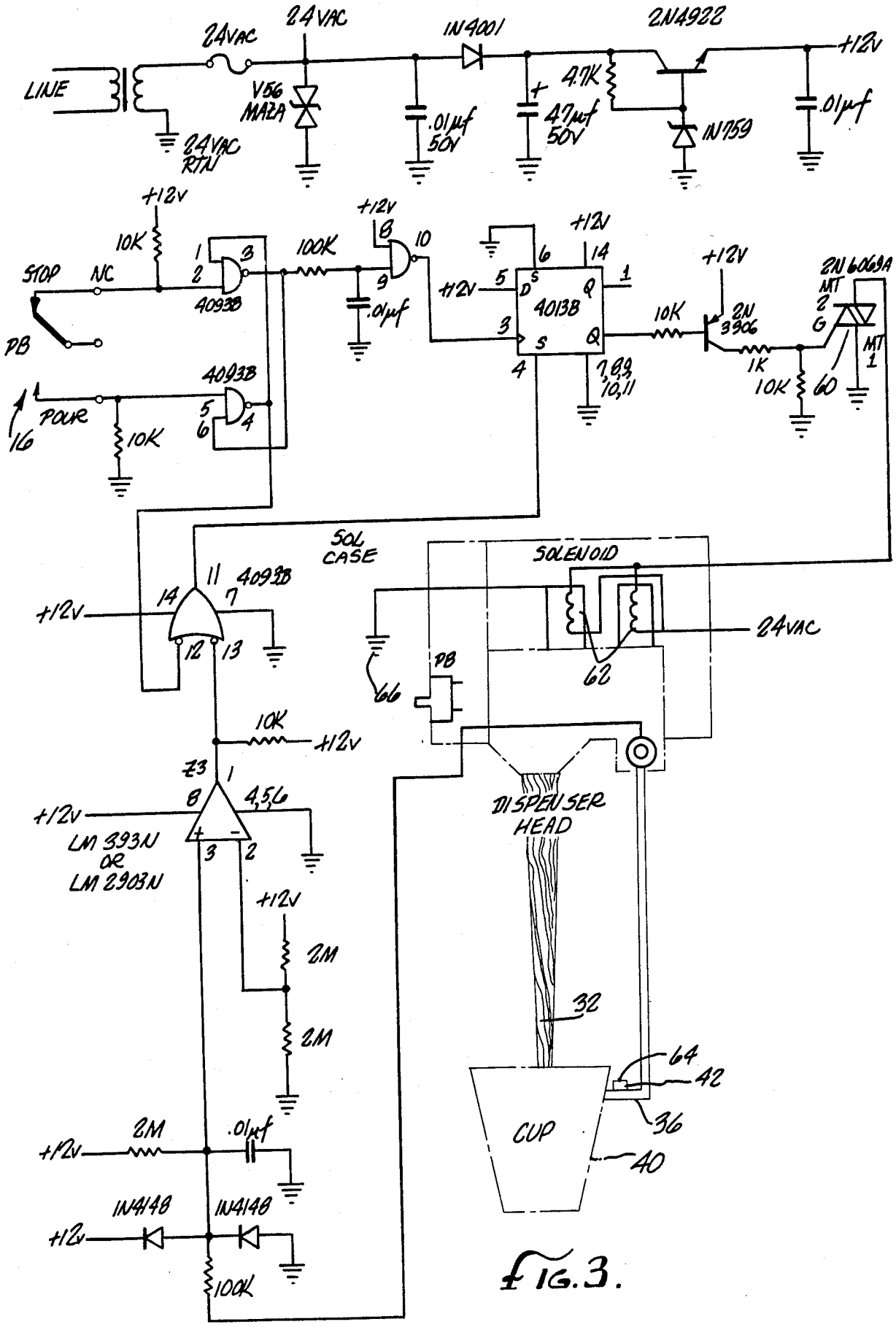
FIG. 3 is a schematic diagram of the electrical/mechanical system of the present invention.

A schematic of the electrical/mechanical system of the present invention shown in FIG. 3. Briefly, the receptacle 40 is placed in contact with the arm 36. The operator then depresses the actuator 16 which causes the triac 60 to conduct. Current passing through the triac 60 will activate the solenoids 62 to open the valves and start the flow of liquid 32. As the receptacle 40 fills and then either liquid or foam overflows the rim of the receptacle 40 the overflow will contact the receptor 42 on the arm 36 at the position 64. An electrical contact exists between the liquid or foam at the position 64 and the solenoid case 66 through the liquid stream 32. The ground thereby placed on component Z3—3 at position 68 will open the triac 60 which will deactuate the solenoids 62 and close the valves and stop the flow of liquid.

In operation, the operator places a receptacle 40 of any size sufficient to fit within the space 24 into the drink dispenser 10, 10'. Because of the unique characteristics of the present invention any size receptacle 40 that fits between the lower portion of the nozzle 30 and either the ramp 44 (FIG. 1) or the base 22 (FIG. 2) may be used. Moreover, any amount of ice may be present in the receptacle 40 yet the present invention will permit filling of the receptacle 40 without substantial overflow or operator attendance.

When using the drink dispenser 10 fitted with the ramp 44 the receptacle 40 will automatically move to a position where an exterior surface of the receptacle 40 below the upper edge contacts the arm 36. As indicated previously, a structure may be attached to the arm 36 to maintain the receptacle 40 in a substantially stationary state. When using the dispenser 10', the operator moves the receptacle 40 into the space 24 until he feels the receptacle 40 contact the arm 36 or any structure attached to the arm 36 operative to maintain the receptacle 40 within the space 24. When the receptacle 40 is positioned to receive a liquid, the operator pushes the button or actuator 16 and initiates the filling cycle. After a certain amount of liquid is received into the receptacle 40, the upper edge of the receptacle 40, which extends over the lower portion of the ramp 44, will overflow causing the liquid to strike the receptor 42 located on the arm 36. The liquid will continue to flow until either foam or liquid, or both, overflow the edge of the receptacle 40 and contact the receptor 42. The overflow will immediately suspend the filling cycle.

Appropriate timer mechanisms may be employed to operate with receptor 42 to establish an absolute maximum flow volume of liquid before terminating the filling cycle. This timer mechanism will act essentially as a backup to remove any possibility that excessive overfill may occur. A volume limit mechanism may also be employed for the same purpose.

The present drink dispenser 10, 10' illustrates a substantial improvement over those presently available. The receptacle 40 may "topped-off" without having to remove the receptacle 40 from the workspace 24 and replace it back into the workspace 24 to rotate a probe or other actuator, and thus recommence the filling cycle. In such a system, oft times foam will strike the receptor prior to the liquid reaching a sufficient level within the receptacle 40, consequently, the operator must remove the receptacle 40 from the workspace 24 and replace the receptacle 40 back into the workspace 24 to reinitiate the filling cycle. Each time the operator performs this function additional spillage may occur. Moreover, in fast food restaurants this is an unnecessary and time consuming procedure that decreases the efficiency of the operator. Each time the operator is required to remove the receptacle 40 to re-initiate the filling cycle the possibility of liquid spillage or ice spillage will also create unnecessary waste and unsanitary conditions.

In addition, and perhaps most importantly, the actual point of contact between receptor 42 and the liquid flowing from the receptacle 40 is below the rim of the receptacle 40. No portion of the liquid dispenser 10 ever comes in contact with the rim of the receptacle 40 or the liquid already in that receptacle 40. This reduces substantially the possibility that any viruses or bacteria located upon the receptor 42, arm 36 or pole 34 will ever become introduced into the liquid in the receptacle 40. In prior devices, the liquid contacting the probe to terminate the filling cycle oft times at least partially falls back into the receptacle, thus transmitting any bacteria or microorganisms from the probe back into the receptacle 40. Such a system creates a substantial problem with certain viruses or bacteria which may exist for a long period of time in the liquid environment commonly found around drink dispensers.

The drink dispenser 10 of FIG. 1 also illustrates a substantial advantage in that the tilting of the receptacle 40 assures that the liquid or foam will always overflow the rim of the receptacle 40 at a well defined location. Furthermore, the tilt of the receptacle 40 prevents the receptacle 40 from filling completely level with the top of the receptacle. This condition would make it extremely difficult to transfer the receptacle 40 from the drink dispenser 10 serving area without spillage.

The present invention also contemplates the use of an arm 36 which is not attached to a pole 34 extending downwardly from the lower faucet housing 14. Rather the arm 36 may extend outwardly from the tower 20 to accomplish the same desirable results. In addition the present invention also contemplates the use of an arm 36 which will support a receptacle without its resting upon a base 22 or a ramp 44. The arm 36 may be inclined to accomplish the same desirable results as the ramp 44.

The present invention also contemplates the use of dedicated receptacles 40 which contain one or more magnetic stripes circumferentially or vertically disposed around the receptacle 40 on either its interior or exterior surface. These would be applied to the receptacle at the time of its manufacture.

The concept behind the use of magnetic stripes on the receptacle is as follows: the receptacle would have on its interior or exterior surface one circumferential stripe (or more) located below the rim of the receptacle but very near the top. These would be connected via another magnetic stripe(s) to a circumferential magnetic stripe located on the very bottom of the receptacle on its exterior surface. The magnetic stripe on the bottom of the receptacle would be in electrical contact with the receptacle support means. The receptacle support means would be part of the sensing circuit. In operation the flowing product would overflow the receptacle, come in contact with the top magnetic stripe or the connecting stripes to the bottom magnetic stripe and thereby complete the circuit and terminate the dispensing cycle. This type of device is also self-compensating for the amount of ice located in the receptacle. The magnetic stripes imprinted upon the receptacle may also have a defined meaning, whereby a magnetic reader may be used to determine receptacle size. Other embodiments include the use of a magnetic sensor which will sense the pressure of the receptacle, whereby the switch operated at the will of the operator will only be active when the sensor determines that a receptacle is present. In other embodiments the magnetic sensor will initiate the filling cycle when the magnetic stripes are proximate thereto by placement of the receptacle into a receiving position.

It will be obvious to those skilled in the art that various changes may be made without departing from the spirit of the invention, and therefore the invention is not limited to what is shown in the drawings and described in detail in the specification, but only as indicated in the appended claims.

We claim:

1. A drink dispenser assembly for filling a receptacle when placed into a position to receive liquid dispensed from a nozzle comprising:

a valve, a solenoid connected to an electric circuit, said solenoid operative to open or close said valve, a switch operated at the will of an operator to actuate the electric circuit and the solenoid to open the valve and initiate a filling cycle, a tower assembly operative to locate the receptacle below the nozzle, an arm attached to said tower assembly, said arm positioned proximate the receptacle when the receptacle is placed into a position to receive liquid, said arm including means for sensing the filled condition of the receptacle, said sensing means operative to deactuate said electric circuit and said solenoid to close said valve and terminate the filling cycle, said sensing means located outside of the receptacle and positioned below the top of the receptacle.

2. The drink dispenser of claim 1 including at least two feed lines controlled by valves, wherein the valves are opened or closed by the action of solenoids, which are actuated by the electric circuit, the feed lines joined in or below the nozzle.

3. The drink dispenser of claim 1, which includes a ramp operative with said tower assembly to position the receptacle below the nozzle in an inclined condition.

4. The drink dispenser of claim 3, wherein the ramp is operative to cause liquid dispensed into the receptacle to overflow the receptacle at a defined location.

5. The drink dispenser of claim 1, wherein the switch is a push switch.

6. The drink dispenser of claim 1, wherein the switch is a capacitance switch.

7. The drink dispenser of claim 1, wherein the switch is a inductance switch.

8. The drink dispenser of claim 1, wherein the switch is a temperature responsive switch.

9. The drink dispenser of claim 1, wherein the switch is a pressure sensitive switch.

10. A drink dispenser assembly used for filling cups when placed into a position to receive liquid dispensesd from a nozzle extending downwardly from a faucet assembly comprising:

a feedline within the faucet assembly, a valve located in the feedline, a solenoid operative with said valve, said solenoid operative to either close or open said valve, a switch operated at the will of an operator, said switch operative to actuate an electric circuit and said solenoid to open the valve and initiate a filling cycle, a base, a ramp attached to said base, said base and said ramp operative to position the cup below the nozzle in an inclined condition, a drain contained in said base, arm means positioned next to the cup when the cup is placed into a position to receive liquid, said arm means having means for sensing the filled condition of the cup, said sensing means including means for deactuating said electric circuit and said solenoid to close said valve and terminate the filling cycle said sensing means positioned relative to the cup whereby overflow of liquid from the cup will contact the sensing means.

11. The drink dispenser of claim 10 which includes means for sensing the presence of the cup within the drink dispenser assembly to actuate the switch.

12. The drink dispenser of claim 10 including support means operative with the arm to maintain the cup stationary within the drink dispenser assembly.

13. The drink dispenser of claim 10 wherein the switch is a push switch.

14. The drink dispenser of claim 10 wherein the switch is a capacitance switch.

15. The drink dispenser of claim 10 wherein the switch is a inductance switch.

16. The drink dispenser of claim 10 wherein the switch is a temperature responsive switch.

17. The drink dispenser of claim 10 wherein the switch is a pressure sensitive switch.

18. A drink dispenser assembly used for filling a receptacle when placed into a position to receive liquid dispensed from a nozzle attached to a faucet assembly comprising:

a support tower operative to suspend the nozzle, a base attached to said support tower, a feedline operative to convey liquid to the nozzle, a valve disposed in said feedline, a solenoid operative with said valve, an electric circuit operative with said solenoid to open or close said valve, switch means for actuating said electric circuit and said solenoid to open said valve and initiate a filling cycle, a ramp attached to said base, wherein said ramp is operative to position the receptacle below the nozzle in an inclined condition, retaining means attached to said support tower for locating the receptacle below the nozzle, means for sensing the filled condition of the receptacle, said sensing means including means for deactuating said electric circuit and said solenoid to close said valve and terminate the filling cycle, said sensing means positioned to receive overflow from the receptacle at a defined location below the rim of the receptacle.

19. The drink dispenser assembly of claim 18 which includes a drain operative with the base.

20. The drink dispenser assembly of claim 18 which includes a means for sensing the presence of a receptacle to actuate the switch to energize the electric circuit and the solenoid to open the valve and initiate the filling cycle.

21. The drink dispenser assembly of claim 18 which includes optic sensing means to determine the filled condition of the receptacle to deactuate the electric circuit and the solenoid to close the valve and terminate the filling cycle.

22. The drink dispenser assembly of claim 18 which includes sonic sensing means for sensing the filled condition of the receptacle to terminate the filling cycle.

23. The drink dispenser assembly of claim 18 which includes magnetic stripes imprinted upon the receptacle and means operative with the drink dispenser for reading the magnetic stripes and sense the presence of the receptacle.

24. The drink dispenser assembly of claim 23 wherein the sensing means includes a magnetic reader to sense the filled condition of the receptacle and terminate the filling cycle.

25. The drink dispenser assembly of claim 24 wherein the magnetic stripes are imprinted on the outside of the receptacle.

26. The drink dispenser assembly of claim 24 wherein the magnetic stripes are imprinted on the inside of the receptacle.

27. The drink dispenser of claim 23 wherein the reading means is operative to initiate the filling cycle when the receptacle is in a position to receive liquid.

* * * * *